US006443373B1

(12) United States Patent
Portugues

(10) Patent No.: US 6,443,373 B1
(45) Date of Patent: Sep. 3, 2002

(54) FLEXIBLE OUTLET CHANNEL STOPPER MEMBRANE

(76) Inventor: Daniel Oswaldo Portugues, Lavalle 1861, Florida, Buenos Aires (AR)

( * ) Notice: Subject to any disclaimer, the term of this patent is extended or adjusted under 35 U.S.C. 154(b) by 0 days.

(21) Appl. No.: 09/655,575

(22) Filed: Sep. 6, 2000

Related U.S. Application Data

(63) Continuation-in-part of application No. 08/979,473, filed on Nov. 26, 1997, now abandoned.

(30) Foreign Application Priority Data

Nov. 29, 1996 (AR) ..... P 960105423

(51) Int. Cl.[7] ..... B05B 1/30

(52) U.S. Cl. ..... 239/533.13; 239/533.14; 239/463; 239/DIG. 12; 239/DIG. 19; 222/494

(58) Field of Search ..... 239/533.13, 533.14, 239/533, 463, 490, 570, DIG. 12, DIG. 19; 222/494, 204

(56) References Cited

U.S. PATENT DOCUMENTS 3,160,329 A * 12/1964 Radic et al. ..... 222/204
4,249,681 A * 2/1981 French ..... 239/533.13
5,836,484 A * 11/1998 Gerber ..... 222/494

FOREIGN PATENT DOCUMENTS

FR 2524348 * 3/1982

* cited by examiner

*Primary Examiner*—William C. Doerrler
*Assistant Examiner*—Dinh Q. Nguyen
(74) *Attorney, Agent, or Firm*—Hughes Hubbard & Reed LLP; Ronald Abramson; Peter A. Sullivan

(57) ABSTRACT

A membrane for most commonly known nozzles has an elastically flexible, compressible resilient material placed between said inside surface of said plate and the opposite surface of the insert face; an annular outer portion that is initially flat; a projection at its center portion in bell-shaped dome form at its active surface which abuts against the inside surface of the central plate, said membrane forming a supplementary recess in its opposite surface and said insert front surface; an annular hermetic seal enclosing a small air chamber, said air chamber being deformable under pressure by the deformation of said membrane; said projecting dome at the center portion of the membrane being seated against the inside walls of the outlet orifice in the plate, describing an annular seal against said walls of said outlet channel. When activated, the projecting dome is selectively displaced by the pressure of the incident contents against the active surface of the membrane; and the sealed chamber increases its compression ratio when deformed by the incident fluid under pressure, providing part of the return force of said dome shape central part of the membrane against the outlet orifice; establishing from the deformation of said membrane a space free from interference between the membrane and said outlet orifice through which contents can flow.

8 Claims, 3 Drawing Sheets

FLEXIBLE OUTLET CHANNEL STOPPER MEMBRANE

This is a continuation-in-part application of application Ser. No. 08/979,473, filed on Nov. 26, 1997 now abandoned.

The present invention relates to outlet nozzles for a fluid under pressure, specifically a flexible membrane acting as an outlet channel stopper for a nozzle that is adaptable for use in already existing spray nozzle constructions without altering or otherwise modifying the existing nozzle construction.

More concretely, the present invention covers improvements in flexible membranes capable of selectively regulating the hermetic closure of a fluid under pressure in outlet nozzles of the type of nozzles capable of emitting a spray cloud, a sprinkling, a definite dosage of a gel, a definite mass of a pasty liquid or cream, a drop or discharge of a gas, or a jet of a liquid according to the design of the nozzle and the result desired.

Nonlimiting examples simply illustrative of these functions are presented by aerosol containers or containers possessing a pump capable of creating a positive pressure in the interior of such containers and discharging the liquid in the form of a fine sprinkling, such as a perfume, etc.

FIELD OF THE INVENTION

For the purposes of the present invention, the following elements shall be named and identified by the terms given below:

NOZZLE: Identifies the body that, in communication with the fluid, permits discharge of the fluid in the ways indicated above.

OUTLET HEAD: Identifies the element which contains or is connected with the pumping element or valve at one end, whereas at its other end it contains or is connected with the nozzle. This outlet head can coincide with the operating element of the valve or pump, and it can be connected to the nozzle either directly or by means of a delivery line for the purpose.

CONTENTS: This defines the fluid, gas, air, or powder contained within the container and intended for discharge through the nozzle.

PACKAGE: This term identifies as such any closed container capable of containing the contents in its interior, maintaining the contents under the pressure of another agent, such as a gas, or by subjecting the contents to the action of a pump capable of exerting pressure on the contents.

BACKGROUND OF THE INVENTION

Aerosol containers and containers possessing a pump or pumping element to deliver their contents are extensively known. These containers discharge their contents through the action of a pump or by means of the action of a gas which keeps the contents under positive pressure.

This is also the case when the contents are subjected to an outside pressure source.

The contents are usually delivered through an outlet nozzle. Nozzles generally consist of small partition walls perpendicular to the direction of the axis of the discharging fluid flow volume provided with a small hole. The inside surface of this partition wall demarcates the front surface of a small chamber within which fluid under pressure arrives from a side clearance.

The interconnection between this clearance and the small chamber is attained by at least one channel that communicates between said clearance and the chamber. This channel can consist of an annular distributor, or it can consist of one or more channels which are radial or eccentric in relation to the center of the partition wall and which coincide with the outlet hole. This arrangement creates a whirlpool effect thereby optimizing the dispersion of the sprinkling cloud. This compartment wall is suitably created by means of a part inserted into the end of the nozzle.

The back surface of this small chamber (considering its front surface the one nearer to the outlet orifice) is defined by an insert piece, which is an elongated element that is coaxial to the axis of the nozzle outlet orifice. The insert piece has a lateral clearance with its housing walls allowing the fluid to flow from the container toward the outlet orifice.

This known construction recognises as one of its main drawbacks that the closure of the container is attained in a distant position to the orifice of the outlet nozzle. For instance, this closure is known to be performed through a valve construction usually placed in a position intermediate between the container and said nozzle.

The contents of said container as a rule can be degraded and sometimes polymerised by prolonged contact with the air. For instance, if the contents is a lacquer, paint, or an organic formulation (medicine) the oxidation or polymerisation of the mass placed between the outlet nozzle and the inner closure valve should be avoided, specially considering that this passage sometimes can be of a significant length, hence the degraded mass of contents is significant, leading to stoppage problems stemming from polymerisation, or even toxicity or the lost therapeutic value stemming from oxidation.

Therefore, the ideal solution to this problem is to provide the nozzle at its outlet with stoppage or closure means of an automatic nature. Thus, when the pump is activated, the pressure from the pump acts on said means, which would release their closing pressure on the outlet orifice. As a soon as the pressure is decreased or eliminated, the closure means will once again hermetically seal said outlet.

The prior Art recognises several constructions attempting to solve this problem. Two relevant prior art reference discuss solutions to this problem:

A) U.S. Pat. No. 4,249,681, to Floyd R. French. This construction depicts a manually operated sprayer for dispensing liquids from a container, having a resilient diaphragm convexed towards and in seating engagement with the dispensing orifice. The diaphragm is designed to flex out of engagement with the outlet orifice when the pressure of the liquid in the pump chamber exceeds the engaging force of the diaphragm. To this end, the resilient diaphragm is made out of a moulded plastic convex hemisphere, which is integral to a dispenser insert having the dispensing orifice 68 and pressed in engagement against the orifice 68 by a stationary partition 61, belonging to the cylinder walls of the pump.

B) French Patent No. FR 2,524,348, to Michel Ramis. This reference also provides the outlet orifice with stopping means, but of an even more radical nature. At FIG. 3 of Ramis, the patent discloses an open-base cylinder with a convex integral diaphragm 20, retained in its convexed (closed) position by means of a complementary shaped jacket 21, which abuts against the insert 22 having the exit orifice.

The most commonly known pressure fluid dispensers each have at its exit nozzle a quite simple construction, which is depicted as part of FIG. 1:

a) an outlet plate (10), with an outlet orifice (11) communicating with an outlet duct provided in plate (10) and secured to an outlet nozzle (1);

b) at least one collecting groove (12) formed in the inner surface of plate (10) and connecting the periphery (13) of said inner surface of plate (10) with said outlet orifice (11);

c) an insert body (20) of cylindrical shape, placed into a cavity (2) of the head of exit nozzle (1), coaxial to orifice (11) of plate (10), determining the cylindrical walls (21) of the lateral surface of insert (20) at least a passage (22) with said cavity, communicating this passage with a pump (not shown) and with the peripheral channel (13). The inner face of the outlet plate (10) abuts and is generally pressed against the foremost surface (23) of the insert body (20), thus defining the collecting channels (24) when faced with said grooves (12).

The above said construction is herein referred to as "most commonly known nozzles" and they constitute a standard in this art area. Millions of these most commonly known nozzles are manufactured daily, and may be found in perfume, medicinal, cosmetic and household cleansing fluid containers.

French and Ramis each provides a sealing and closing action against an outlet orifice, but neither construction is adaptable to the existing most commonly known nozzles. In fact, both prior art constructions must be specifically moulded and their components are not interchangeable or adaptable to these most commonly known nozzles.

It is impossible to place any of the components into the most commonly known nozzles because they simply will not fit, owing to the fact that both French and Ramis are specific constructions needing an extensive redesign of the spraying nozzle head, hence the known prior art will not provide closing and sealing means capable to operate against the outlet orifice in the most commonly known nozzle constructions.

OBJECT OF THE INVENTION

It is an object of this invention to make an elastically flexible membrane which is plane-shaped at its annular perimetral area, capable of providing a sealing and closing means acting directly against the outlet orifice of a nozzle placed in connection to an outlet head for a fluid under pressure, where this membrane is capable of being introduced into any of the most commonly known nozzles as above defined, without introducing any modification in these most commonly known nozzles, or in their functions or results.

It is also an object of this invention to make a membrane which is capable of adapting itself to any irregularity to be found in the abutting surfaces of the insert and plate, creating an annular seal between said surfaces.

It is also an object of this invention to make a membrane capable of establishing between it and the abutting surface of the insert against which it perimetrically rests, a small air containing deformable sealed chamber that deforms when the membrane is deformed and is capable of compressing the volume of air therein enclosed.

It is another object of this invention to make a membrane which is rendered plane within said hermetic chamber, freeing the passage of communication with the outlet orifice.

It is still another object of this invention to make a membrane which can be constructed with a material different from the material from which said outlet nozzle, plate and insert and formed.

It is a further object for this invention, that said membrane is capable of having its thickness reduced by compression between said two abutting surfaces from 5% to 40% of its initial thickness.

SUMMARY OF THE INVENTION

In an outlet nozzle of a fluid contained in a container and deliverable under positive pressure, which outlet nozzle possesses a plate with an outlet hole in communication with an outlet delivery line, said plate having collecting channels and possibly formers of the outlet vortex of the impelled fluid, the plate being retained by an insert which laterally describes at least one passage for the fluid contained in a container to which said construction is attached. The insert has a foremost surface abutting against the inner surface of said front plate, which provides the laterally closing wall of said groove, thereby defining a channel for said fluid in communication with said passage. A membrane made out from an elastically flexible, compressible resilient material is interposed between said inside surface of said plate and the opposite surface of the insert face. This membrane has an annular outer portion that is initially flat, and a center portion having a projection in bell-shaped dome form at its active surface that abuts against the inside surface of the central plate. The membrane also has a supplementary recess in its opposite surface that faces the insert front surface. The membrane forms in its plane zone an annular hermetic seal which encloses in the space defined by the supplementary recess and insert front surface a small air-tight chamber filled with air. This chamber is deformable under pressure by the deformation of the membrane; and the membrane material is partially forced into any recess or cavity in said zones, including the said groove, thus providing the lateral closing wall defining the channel, ensuring the hermetic seal of same along the surface of said membrane. The projecting dome at the center portion of the membrane is seated against the inside walls of the outlet orifice in the plate, describing an annular seal against said walls of said outlet channel. When the projecting dome is selectively displaced by the pressure of the incident contents against the active surface of the membrane, the sealed chamber increases its compression ratio when deformed by the incident fluid under pressure, providing part of the return force of said dome shape central part of the membrane against the outlet orifice; establishing the deformation of said membrane a space free from interference between the membrane and said outlet orifice.

Many embodiments can be designed on the basis of this combination, but for the purpose of providing a preferred embodiment of the invention, the following construction is now described, with the aid of the attached drawings. This embodiment and drawings are provided merely as an example with no limiting purposes to the actual scope of the invention.

FIG. 1 represents a cross section of the most commonly known nozzles as above explained, without the membrane of the invention. This figure depicts the cross section of a state of the art nozzle. In this figure, plate (10) has its cross section taken at the plane AA' of FIG 1*a;*

FIG. 1*a* shows a plane view of the inner face of the plate, showing the most usual array of grooves for the distribution and vortex creation for the fluid;

FIG. 4 shows the membrane under deformation performed by the fluid pressure, liberating the exit orifice;

The same components and means hereafter mentioned and illustrated are identified in the specification and figures, with the same reference numerals.

Figure 1:
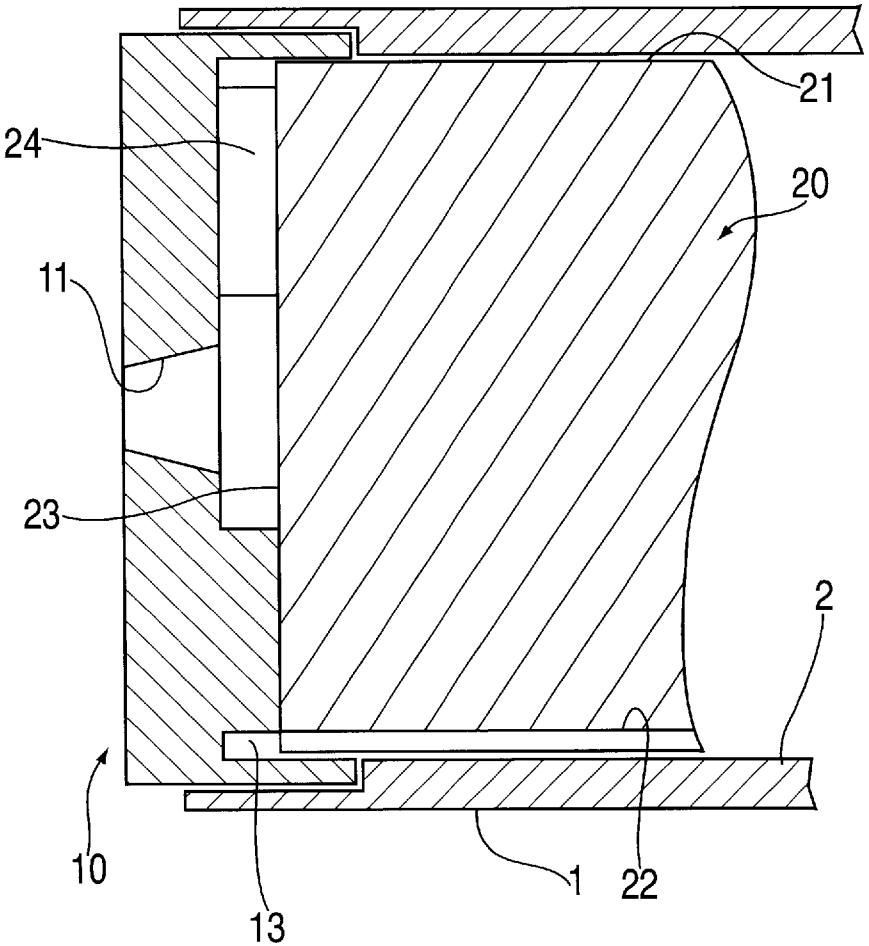
Figure 1A:
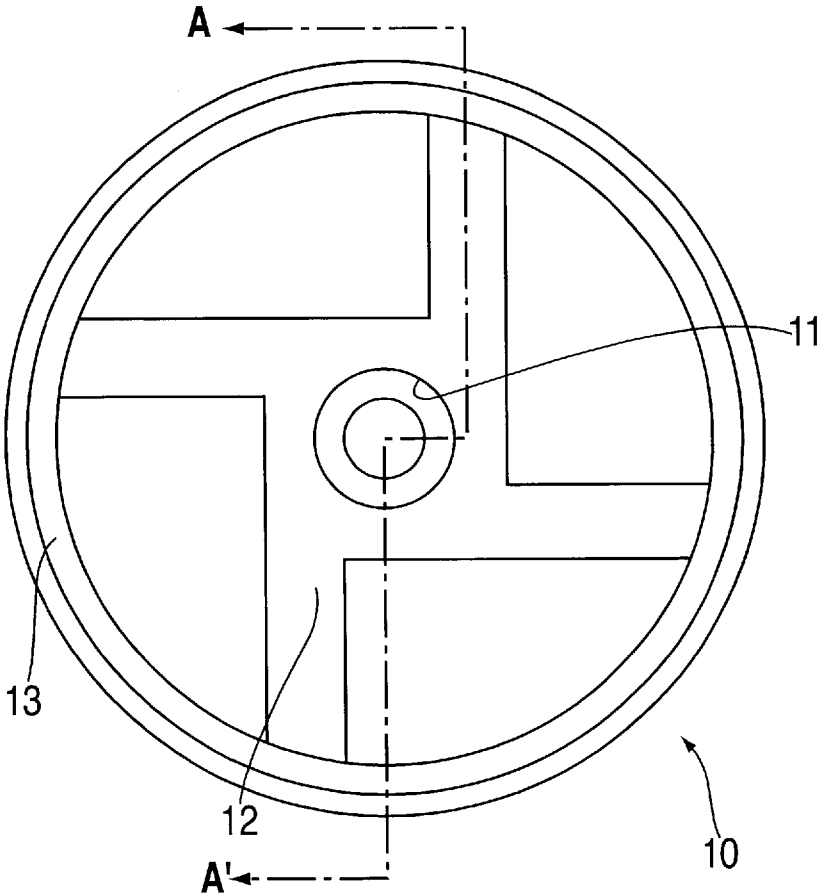

The state of the art most commonly known nozzles depicted schematically at FIG. 1 and 1*a*, comprises an outlet plate (10), with an outlet orifice (11) communicating with an outlet duct provided in said plate (10) and secured to an outlet nozzle (1). This plate (10) has at least one collecting groove (12) formed in the inner surface of plate (10) and connecting the periphery (13) of said inner surface of plate (10) with said outlet orifice (11). The constructions is completed by an insert body (20) of cylindrical shape, placed into a cavity (2) of said exit nozzle head (1), coaxial to said orifice (11) of plate (10), determining the cylindrical walls (21) of the lateral surface of said insert (20) at least a passage (22) with said cavity, communicating this passage with a pump (not shown) and with the peripheral channel (13). The inner face of the outlet plate (10) abuts and is generally pressed against the foremost surface (23) of the insert body (20), thus defining the collecting channels (24) when facing said grooves (12). There are no hermetic seals provided in said most commonly known nozzles because these state of the art constructions did not required them.

This invention provides a closing and air tight seal performing against the inner lips of the outlet orifice without modifying the above said known constructions. That is, any manufacturer can apply this membrane thus transforming its state of the art product into a novel nozzle head capable of a sealing and air-tight closing action against the outlet orifice.

Figure 3:
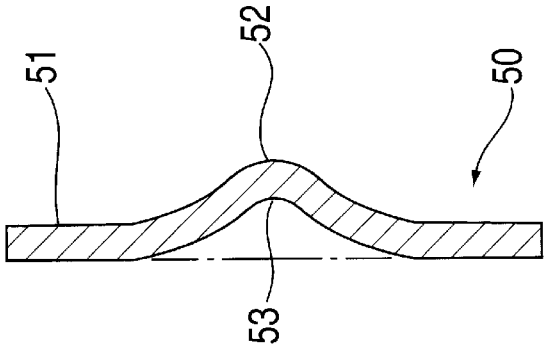
FIG. 3 depicts said membrane according to the cross section as per plane BB' of FIG. 2.
Figure 2:
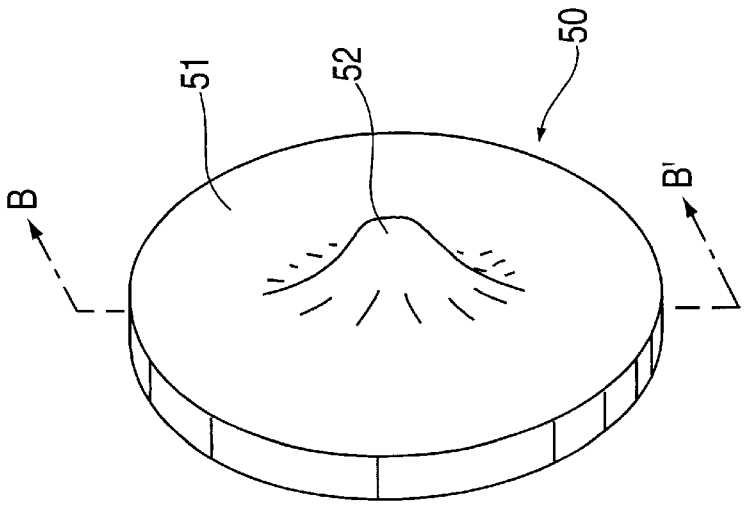
FIG. 2 shows a perspective view of the membrane by itself.
Figure 4:
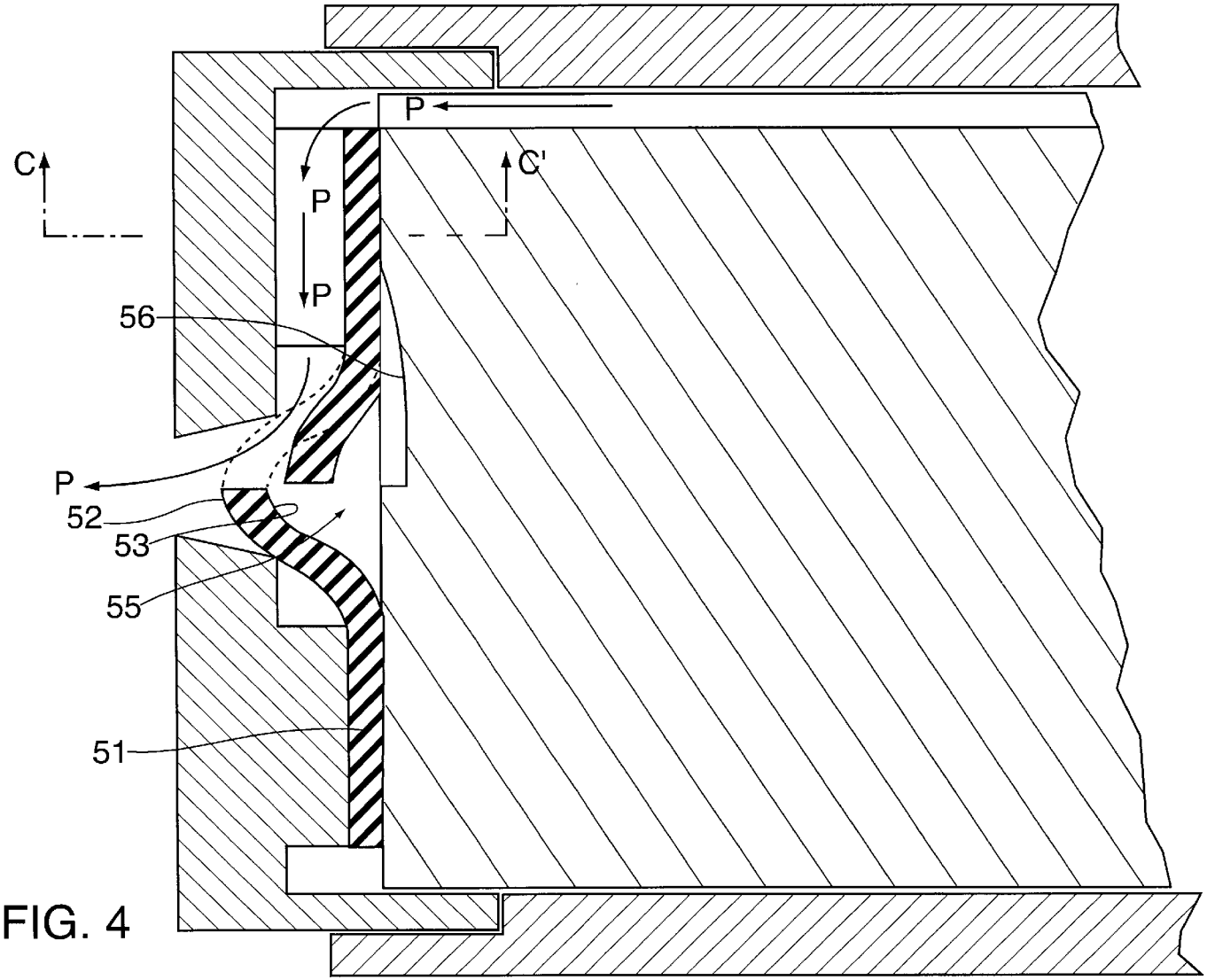
FIG. 4 shows the most commonly known nozzles when provided with the membrane of this invention, in the same cross section, showing its left hand side portion thereof the membrane in its sealing position, while the right hand side part of this same

This instant invention is characterised by the interposition of a membrane made from an elastically flexible, compressible resilient material placed between the inside surface of the plate and the opposite surface of the insert face. FIG. 2 shows said membrane (50) in a simplified perspective view. This membrane has a general disk form shape, with an annular outer portion (51) that is coplanar and generally "floppy", that is, it adapts itself easily to any other shape by elastic deformation when pressed or otherwise solicited. The center of the membrane has on one of its faces a bell shaped projection (52), and on the opposite face a corresponding concavity (53) (FIG. 3). This bell shaped projection is more resilient than said annular floppy portion (51), due to its shape. Said membrane has an annular outer portion thereof (51) which is-initially flat, while at its center portion it has a projection in bell-shaped dome form (52) at its active surface which abuts against the inside surface of the central plate. The membrane has a supplementary recess (53) in its opposite surface that faces the insert front surface (23). Said membrane is strongly pressed in its flat annular outer portions (51) against the inside surface of the plate by said insert (20), producing a flat annular hermetic seal in their two respective annular surfaces in the annular zone of the membrane thus pressed. The membrane material (54) is partially forced into any recess or cavity in said zones, including said groove (12), thus providing the lateral closing wall defining the channels (24), and ensuring the hermetic seal of same along the surface of said membrane. Said projecting dome (52) at the center portion of the membrane is seated against the inside walls of the outlet orifice (11) in the plate, describing an annular seal against said walls of said outlet channel. The projecting dome is selectively displaceable by the pressure of the incident contents against the active surface of the membrane (see arrows P, in FIG. 4). Said membrane forms a small sealed air chamber (55) against the foremost surface (23) of the insert, being this sealed chamber annularly delimited by the flat zone of the membrane pressed between the insert and plate, and initially filled with air at atmospheric pressure. The sealed chamber has a volume with a compression ratio of 25% to 50% of its volume when deformed by the incident fluid under pressure, this compression providing part of the return force of the dome shape central part of the membrane to its sealing position against the outlet orifice. This membrane has a thickness, before compression, of between 0.03 mm to 1 mm, having its thickness reduced by compression between said two abutting surfaces by 5 to 40% of its initial thickness, while its diameter is compatible with the inner diameter of the circular collecting channel (13) in the plate against which it rests.

The front surface (23) of the insert (20) can have a small depression (56) which helps to regulate the return force due to the air compression into this small air chamber.

It is also noticed that in this instant invention, and quite contrary to the teachings of the known prior art (see e.g. French patent mentioned above), the membrane has a small compression chamber (55), which has an area about 30% to 70% of the total area of the membrane, while part of the membrane remains locked by compression between the abutting components (10, 20), and it is only free to flex or hinge at the initial base of the bell shaped dome (52), which does not allow for a distribution of the tensions due to deformation of this dome under pressure, and further helps to aid in the return sealing force of said dome against orifice (11).

Figure 5:
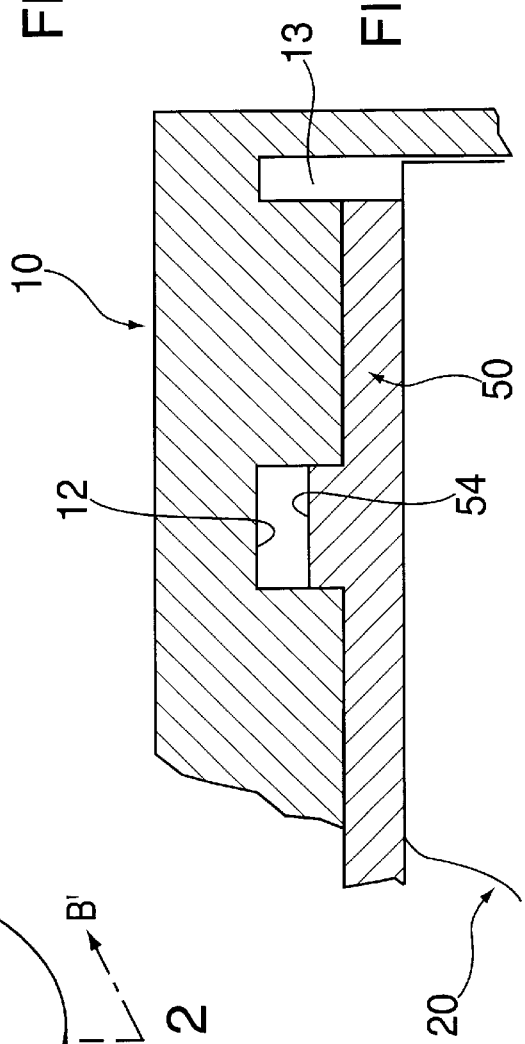
FIG. 5 shows a cross section of said membrane, pressed and deformed into the cavities and grooves, forming the fourth wall of the channel in the plate with the outlet orifice, according to plane CC' of FIG. 4.

FIG. 5 helps to illustrate another unique feature of this invention, not to be found in any of the cited prior art. Membrane (50) is strongly pressed in its flat annular outer portions (51) against the inside surface of the plate (10) by said insert (20), producing a flat annular hermetic seal in their two respective annular surfaces in the annular zone of the membrane thus pressed, being the membrane material (54) partially forced into any recess or cavity in said zones, including said groove (12), thus providing the lateral closing wall defining the channels (24) (FIG. 2), ensuring the hermetic seal of same along the surface of said membrane. In another embodiment, the hermetic seal may be achieved by heat sealing the perimeter of the membrane to the insert. This is a unique feature, since otherwise if this membrane would be incapable of being deformed into the parts (54), it would be impossible to ensure the air-tight seal of the walls completing the channels (24) (FIG. 2), which is provided by the abutting face of said membrane. The ratio within which the membrane material can be pressed and thus deformed varies from 5% to 40% of the initial thickness of the membrane.

I claim:

1. A Flexible outlet channel stopper membrane adaptable to existing spraying nozzles of the kind comprising an outlet nozzle with a front plate with an outlet orifice in communication with an outlet delivery line, said plate having in its inner face collecting grooves of the outlet vortex of the impelled fluid, the plate being retained by an insert which laterally describes at least one passage for the fluid contained in a container to which said construction is attached, having said insert a foremost surface abutting against the inner surface of said front plate and providing the laterally closing wall of said groove, defining a channel for said fluid in communication with said passage, said membrane comprising an elastically flexible, compressible resilient material insertably retained between said inside surface of said plate and the opposite surface of the insert face;

an annular outer portion that is initially flat;

a projection at its centre portion in bell-shaped dome form at its active surface which abuts against the inside surface of the central plate, said membrane forming a supplementary recess in its opposite surface and said insert front surface;

an annular hermetic seal enclosing a small air chamber, said air chamber being deformable under pressure by the deformation of said membrane; said projecting dome at the centre portion of the membrane being seated against the inside walls of the outlet orifice in the plate, describing an annular seal against said walls of said outlet channel, said projecting dome selectively displaced by the pressure of the incident contents against the active surface of the membrane; said sealed chamber increases its compression ratio when deformed by the incident fluid under pressure, providing part of the return force of said dome shape central part of the membrane against the outlet orifice; establishing the deformation of said membrane a space free from interference between the membrane and said outlet orifice.

2. The membrane according to claim 1, wherein said membrane material is partially pressed against a recess or projection on the insert or plate surfaces, adjacent to said membrane, including said groove, providing the closing wall of said grove thus defining a channel with said groove which is hermetically sealed along the abutting surface of said membrane.

3. The membrane according to claim 1, wherein said hermetically sealed chamber defined between said abutting membrane and insert is formed by a pressure exerted against said membrane by said insert.

4. The membrane according to claim 1, wherein said hermetically sealed chamber defined between said abutting membrane and insert is formed by a perimetrical annular heat sealing of the membrane against said insert surface.

5. The membrane according to claim 1, wherein said membrane is made from a material which is different form the material from which said nozzle, insert or plate are made.

6. The membrane according to claim 1, wherein said membrane is forming an annular closed hermetically sealed small chamber and said insert has a small depression facing said membrane.

7. A spray nozzle for a container comprising an outlet nozzle with a front plate with an outlet orifice in communication with an outlet delivery line, said plate having an inner face having collecting grooves of an outlet vortex of an impelled fluid;

an insert retaining said plate and which laterally describes at least one passage for said fluid contained in said container, said insert having a foremost surface abutting against said inner surface of said front plate and providing the laterally closing wall of said collecting grooves, defining a channel for said fluid in communication with said passage;

an elastically flexible, compressible resilient membrane insertably retained between said inside surface of said plate and the opposite surface of the insert face; said membrane having an annular outer portion that is initially flat; a projection at its centre portion in bell-shaped dome form at its active surface which abuts against the inside surface of the central plate, said membrane forming a supplementary recess in its opposite surface and said insert front surface; an annular hermetic seal enclosing a small air chamber, said air chamber being deformable under pressure by the deformation of said membrane; said projecting dome being seated against the inside walls of the outlet orifice in the plate, describing an annular seal against said walls of said outlet channel, said projecting dome selectively displaced by the pressure of the incident contents against the active surface of the membrane; said sealed chamber increasing its compression ratio when deformed by the incident fluid under pressure, providing part of the return force of said dome shape central part of the membrane against the outlet orifice; establishing from the deformation of said membrane a space free from interference between the membrane and said outlet orifice through which said contents can flow.

8. A flexible outlet channel stopper membrane adaptable to existing spraying nozzles of the kind comprising an outlet nozzle with a front plate with an outlet orifice in communication with an outlet delivery line, said plate having in its inner face collecting grooves of an outlet vortex of the impelled fluid, the plate being retained by an insert which laterally describes at least one passage for the fluid contained in a container to which said construction is attached, having said insert a foremost surface abutting against the inner surface of said Font plate and providing the laterally closing wall of said groove, defining a channel for said fluid in communication with said passage, said membrane comprising an elastically flexible, compressible resilient material insertably retained between said inside surface of said plate and the opposite surface of the insert face;

an annular outer portion that is initially flat;

a projection at its centre portion in bell-shaped dome form at its active surface which abuts against the inside surface of the central plate, said membrane forming a supplementary recess in its opposite surface and said insert front surface;

an annular hermetic seal enclosing a small air chamber, said air chamber having a surface area about 30 to 70% of the total surface area of the membrane, said air chamber being deformable under pressure by the deformation of said membrane; said projecting dome at the centre portion of the membrane being seated against the inside walls of the outlet orifice in the plate, describing an annular seal against said walls of said outlet channel, said projecting dome selectively displaced by the pressure of the incident contents against the active surface of the membrane; said sealed chamber increases its compression ratio when deformed by the incident fluid under pressure to a range of between 25 and 50%, providing part of the return force of said dome shape central part of the membrane against the outlet orifice; establishing the deformation of said membrane a space free from interference between the membrane and said outlet orifice.

* * * * *

UNITED STATES PATENT AND TRADEMARK OFFICE

CERTIFICATE OF CORRECTION

PATENT NO. : 6,443,373 B1
DATED : September 3, 2002
INVENTOR(S) : Portugues

It is certified that error appears in the above-identified patent and that said Letters Patent is hereby corrected as shown below:

Column 8,
Line 34, please delete "Font" and insert -- front --.

Signed and Sealed this

Fourteenth Day of January, 2003

JAMES E. ROGAN
*Director of the United States Patent and Trademark Office*